United States Patent [19]

Koehn

[11] Patent Number: 4,829,805

[45] Date of Patent: May 16, 1989

[54] CRIMP TOOL

[75] Inventor: Terry J. Koehn, Geneva, Ill.

[73] Assignee: Ideal Industries, Inc., Sycamore, Ill.

[21] Appl. No.: 172,700

[22] Filed: Mar. 17, 1988

[51] Int. Cl.[4] ..... B21D 7/06

[52] U.S. Cl. ..... 72/410; 81/421; 81/313; 29/751

[58] Field of Search ..... 72/410, 409, 413, 481; 29/751; 81/421-423, 313; 269/284, 280

[56] References Cited

U.S. PATENT DOCUMENTS

| | | | |
|---|---|---|---|
| 2,637,236 | 5/1953 | Vergnani et al. | 81/421 |
| 2,869,407 | 1/1959 | Swanson | 72/409 |
| 3,057,233 | 10/1962 | Turner | 72/409 |
| 4,292,833 | 10/1981 | Lapp | 72/410 |
| 4,583,671 | 4/1986 | Cressy | 81/421 |
| 4,614,107 | 9/1986 | Norin | 72/410 |

FOREIGN PATENT DOCUMENTS

| | | | |
|---|---|---|---|
| 574015 | 4/1959 | Canada | 72/410 |
| 522435 | 7/1921 | France | 72/409 |
| 1522144 | 8/1978 | United Kingdom | 72/410 |

*Primary Examiner*—Daniel C. Crane

*Attorney, Agent, or Firm*—Kinzer, Plyer, Dorn, McEachran & Jambor

[57] ABSTRACT

A ratchet crimp tool has upper and lower handles joined by a ratchet member. An upper jaw is fixed to the upper handle. A lower jaw is pivotally connected to both handles. The jaws have attachment elements disposed in facing relation. Upper and lower crimp nests are slidably mounted on the attachment elements. The crimp nests have arms which define a channel, which in turn meshes with the associated attachment element in interlocking engagement. Ball detents are mounted in holes in the jaws. The detents engage the crimp nests to retain them on the jaws. An interlocking pin and slot arrangement is provided to insure proper orientation of the nests on the jaws.

10 Claims, 1 Drawing Sheet

Fig. 1.
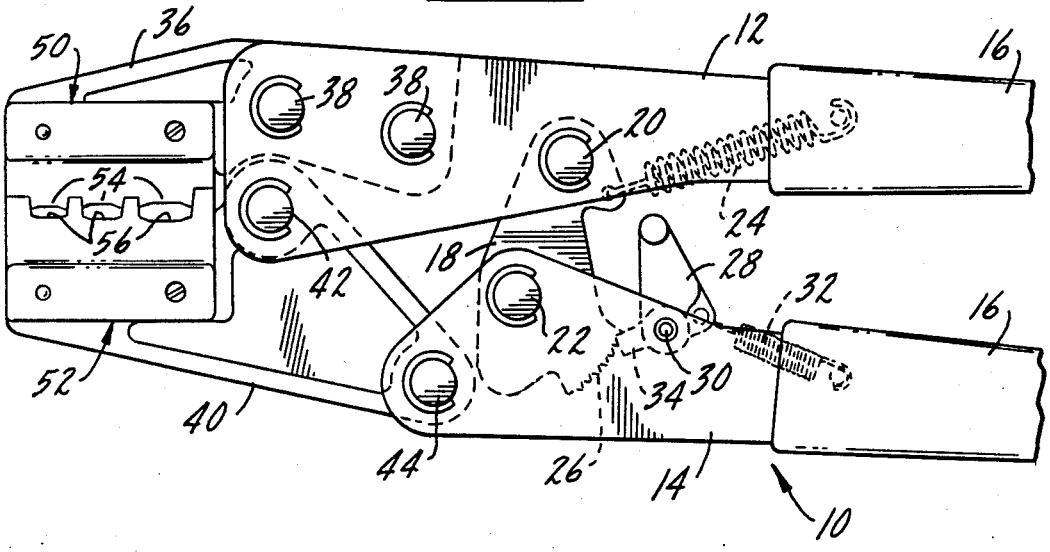
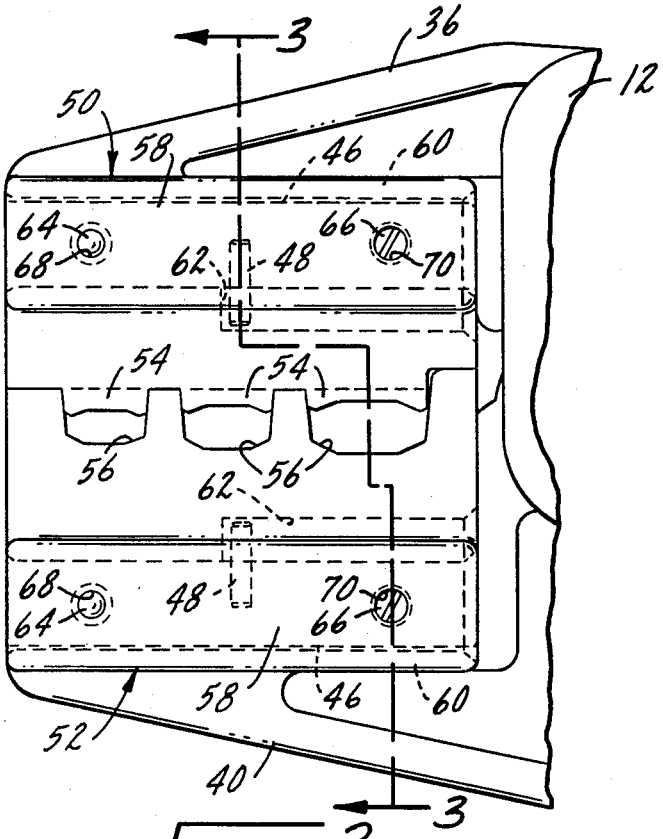
Fig. 2.
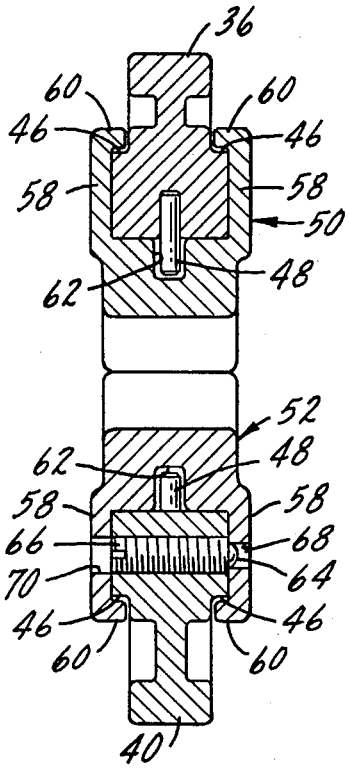
Fig. 3.

CRIMP TOOL

BACKGROUND OF THE INVENTION

This invention relates to a crimp tool of the type used for crimping terminals, splices, disconnects and the like onto electrical wires or cables. These parts, of course, are made in a variety of sizes to accommodate different wire sizes. Accordingly, a crimp tool must be capable of crimping various size parts. This is ordinarily accomplished by providing crimp nests designed for a specific part size, or perhaps a range of sizes. In any case, crimp nests of various sizes are required to handle the full range of parts commonly encountered in electrical work.

While a plurality of separate tools could be provided for the various sizes required, it is the more common practice to use interchangeable crimp nests which fit on a common set of handles. This approach has the advantage of reducing the cost of tools needed to complete a job. But it creates the inconvenience of having to stop and change out the crimp nests whenever a part is encountered which does not fit the presently-mounted nests. Crimp nests which are bolted in place require the use of a screw driver to remove the fastening bolts. This relatively laborious and time-consuming procedure reduces the productivity of the electrician.

Another difficulty with removable crimp nests is the possibility of installing one of the parts incorrectly, resulting at least in loss of time and possibly in damage to the tool and/or work pieces.

SUMMARY OF THE INVENTION

This invention relates to a crimp tool and is particularly directed to a hand-held ratchet crimp tool.

A primary object of the invention is a crimp tool having replaceable crimp nests which can be mounted without the use of any other tools.

A further object of the invention is a crimp tool which insures mounting of the crimp nests in the proper orientation.

These and other objects are achieved by a crimp tool having upper and lower crimp nests mounted on jaws. The jaws are movable by handles to carry the crimp nests into and out of engagement. The crimp nests are retained on the jaws by ball detents. An interlocking pin and slot arrangement assures proper orientation of the crimp nests on the jaws.

BRIEF DESCRIPTION OF THE DRAWINGS

FIG. 1 is a side elevation view, with portions removed, of the crimp tool of the present invention.

FIG. 2 is an enlarged detail view of the crimp nests and portions of the jaws of the crimp tool.

FIG. 3 is a section taken generally along line 3—3 of FIG. 2.

DETAILED DESCRIPTION OF THE INVENTION

A hand-held ratchet crimp tool 10 is illustrated in FIG. 1. The tool includes an upper handle 12 and a lower handle 14. The outer ends of the handles may be covered by sleeves 16. The handles are joined by a ratchet member 18 which is pivotally connected to the upper and lower handles by pins 20 and 22, respectively. The ratchet member is biased about the pin 20 by a ratchet spring 24 which is attached to the ratchet member and to the upper handle 12. A plurality of teeth

26 are formed on one edge of the ratchet member. A pawl 28 is pivotally connected to the lower handle 14 by pin 30. A pawl spring 32 connected between the pawl and the lower handle 14 biases the pawl about the pin 30. The pawl has a portion 34 which is engageable with the teeth 26 of the ratchet member.

The crimp tool 10 further includes an upper jaw 36 which is rigidly attached to the upper handle 12 by bolts 38. A lower jaw 40 is pivotally connected to both the upper and lower handles, 12 and 14. A center pin 42 connects the lower jaw 40 to the upper handle. A lower pin 44 pivotally connects the lower jaw to the lower handle.

Looking at FIG. 3, the jaws 36 and 40 each have shoulders 46 along an edge thereof. The shoulders define attachment elements which are in facing relation to one another. The jaws further include drive lock pins 48 which protrude from the edge surface of the jaws.

Upper and lower crimp nests, shown generally at 50 and 52, are mounted on the upper and lower jaws 36 and 40. The upper nest 50 has extensions 54 which fit into sockets 56 when the jaws are closed to perform the crimping function. Each set of crimp nests may have a plurality of mating extension and socket pairs. Such pairs have different sizes to accommodate the variable sizes of parts to be crimped. The projections and sockets could also have different shapes to effect different types of crimping.

The crimp nests each have a pair of arms 58 with inwardly-directed fingers 60 on the ends thereof. The arms define channels therebetween which accommodate the edge portions of the jaws 36, 40 in interlocking engagement. The fingers 60 engage the shoulders 46 to hold the crimp nests on the jaws.

The crimp nests further include longitudinal slots 62 which extend from one end of the nests and partially therethrough. The slots 62 accept the drive lock pins 48, as seen in FIG. 3. Since the slots open to only one end of the crimp nests, the nests cannot be incorrectly installed on the jaws. That is, one of the nests cannot be put on backwards which would otherwise destroy the correlation between the sizes of the extensions 54 and sockets 56.

The crimp nests are retained in position on the jaws by ball detents which fit into threaded holes in the jaws. The ball detents have spring-loaded ball portions 64 and adjustment screws 66. One of the crimp nest arms 58 has an opening 68 which receives the ball portion 64. A second opening 70 in the other crimp nest arm provides access to the screw portion 66 to permit adjustment of the spring tension on the ball 64.

The use of the crimp tool is as follows. The ratchet spring 24 normally holds the jaws and handles in an open position, wherein the crimp nests are spaced from one another. The part to be crimped is placed in the appropriate socket 56 and then the user squeezes the handles 12 and 14 together. This causes the lower handle to shift generally toward the left, as seen in FIG. 1, with the ratchet 18 pivoting about pin 20. As this occurs, the lower jaw 40 pivots about pin 42, carrying the lower crimp nest into engagement with the upper nest. The pawl 28 engages the teeth 26 of the ratchet, preventing opening of the handles until the pawl has moved all the way across the ratchet teeth. Thus, the tool cannot be opened until a complete crimp has been made. This is commonly known as a full cycle tool. As the jaws close, the crimp nests provide the crimping action on the work piece or part. Once the full crimping has been completed, the pawl disengages the ratchet and spring 24 opens the tool up.

When a different set of crimp nests is required, the user can simply pull the present set of crimp nests off of the jaws, overcoming the retaining force of the ball detents. The new crimp nests are mounted on the tool by sliding the nests onto the shoulders of the jaws until the ball detent 64 engages opening 68. The ball detent will snap into position in the opening, preventing removal of the nests under casual force. As mentioned above, the nests will only fit on one way due to the interaction of the drive lock pin 48 and slot 62.

It can be seen that this arrangement for mounting the crimp nests allows change out of the nests without use of any extra tools and without removing any parts other than the nests themselves. At the same time, the nests are held securely on the jaws so they will mesh properly for performing the crimping operation.

Whereas a preferred form of the invention has been shown and described, it will be realized that alterations may be made thereto without departing from the scope of the following claims.

I claim:

1. A crimp tool, comprising:

elongated upper and lower handles joined for pivoting motion relative to one another about a pivot axis and defining a longitudinal axis of the tool, said pivot axis extending transverse to said longitudinal axis;

upper and lower jaws connected at one end thereof to one end of the handles, the jaws extending generally longitudinally beyond the handles to a free end of each jaw, defining edges which are in facing relation and terminate at a free end of each jaw;

attachment elements formed along said edges of each jaw, the attachment elements extending generally parallel to the longitudinal axis of the tool to the free ends of the jaws;

upper and lower crimp nests having attachment means adapted to only slide longitudinally substantially parallel to the longitudinal axis of said handles onto the free ends of the upper and lower jaws, respectively, such that the attachment means of the nests are in interlocking engagement with the attachment elements of the jaws, the crimp nests having at least two different-sized pairs of extensions and sockets; and a ball detent disposed in holes formed in each of the jaws, each ball detent being engageable with the crimp nest to retain it on the jaw.

2. The crimp tool of claim 1, further comprising a drive lock pin affixed to each attachment element and wherein the crimp nests have a slot extending from one end thereof partially through the crimp nest, the slot being engageable with a drive lock pin to ensure installation of the nests in the correct orientation.

3. The crimp tool of claim 1 wherein each attachment element comprises a pair of shoulder formed on the edge of the jaw and wherein the crimp nest arms have fingers engaging the shoulders.

4. The crimp tool of claim 1 wherein one of the arms of each crimp nest has an opening aligned with the hole in the associated attachment element to receive the ball detent.

5. The crimp tool of claim 4 wherein the other of said arms has a second opening aligned with the hole in the associated attachment element to provide access to the ball detent for adjustment thereof.

6. The crimp tool of claim 1 wherein the handles are connected by a ratchet pivotally attached to the handles.

7. The crimp tool of claim 6 further comprising a pawl pivotally connected to the lower handle and engageable with the ratchet.

8. The crimp tool of claim 7 further comprising a ratchet spring connected between the upper handle and the ratchet and effective to open the tool upon disengagement of the pawl from the ratchet after completion of a crimp.

9. The crimp tool of claim 6 wherein the lower jaw is pivotally connected to both the upper and lower handles.

10. A crimp tool, comprising:

upper and lower handles joined for pivoting motion relative to one another about a pivot axis;

upper and lower jaws on the handles, said jaws having attachment elements which are in facing relation on opposed edges of the jaws;

a drive lock pin affixed to the attachment element on each jaw;

upper and lower crimp nests slidably mounted on the attachment elements of the upper and lower jaws, respectively, the crimp nests having attachment means which mesh with the attachment elements in interlocking engagement, the crimp nests having at least two different-sized pairs of extensions and sockets, and the crimp nests having a slot extending from one end thereof partially through the crimp nest, the slot being engageable with a drive lock pin to ensure installation of the nests in the correct orientation; and a ball detent disposed in holes formed in each of the jaws, each ball detent being engageable with the crimp nest to retain it on the jaw.

* * * * *